US007616176B2

(12) United States Patent
Yi et al.

(10) Patent No.: US 7,616,176 B2
(45) Date of Patent: Nov. 10, 2009

(54) PLASMA DISPLAY AND DRIVING METHOD THEREOF

(75) Inventors: Jeong-Doo Yi, Suwon-si (KR); Jeong-Nam Kim, Suwon-si (KR); Tae-Woo Kim, Suwon-si (KR); Joon-Yeon Kim, Suwon-si (KR); Su-Yong Chae, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 701 days.

(21) Appl. No.: 10/998,469

(22) Filed: Nov. 29, 2004

(65) Prior Publication Data

US 2005/0140589 A1 Jun. 30, 2005

(30) Foreign Application Priority Data

Nov. 28, 2003 (KR) ..... 10-2003-0085465

(51) Int. Cl.
*G09G 3/28* (2006.01)

(52) U.S. Cl. ..... 345/67; 313/595

(58) Field of Classification Search ..... 345/60–72, 345/204; 313/567–643; 315/169.1, 169.4
See application file for complete search history.

(56) References Cited

U.S. PATENT DOCUMENTS

| | | | | |
|---|---|---|---|---|
| 6,504,519 | B1 | 1/2003 | Ryu et al. | |
| 6,717,557 | B2 * | 4/2004 | Ishizuka | 345/60 |
| 6,791,516 | B2 * | 9/2004 | Kang | 345/63 |
| 7,167,144 | B2 * | 1/2007 | Tessier | 345/60 |
| 7,227,513 | B2 * | 6/2007 | Lee et al. | 345/60 |
| 2002/0005822 | A1 * | 1/2002 | Lee et al. | 345/60 |
| 2002/0047578 | A1 | 4/2002 | Kishi et al. | |
| 2002/0053883 | A1 * | 5/2002 | Choi | 315/169.3 |
| 2002/0084953 | A1 | 7/2002 | Yoon et al. | |
| 2002/0135542 | A1 | 9/2002 | Kim et al. | |
| 2003/0090443 | A1 | 5/2003 | Kobayashi | |
| 2003/0132898 | A1 | 7/2003 | Akiba | |

FOREIGN PATENT DOCUMENTS

CN 1349242 A 5/2002

(Continued)

OTHER PUBLICATIONS

Patent Abstracts of Japan, Publication No. 09-245627, dated Sep. 19, 1997, in the name of Takayoshi Nagai et al.

(Continued)

*Primary Examiner*—Amr Awad
*Assistant Examiner*—Stephen G Sherman
(74) *Attorney, Agent, or Firm*—Christie, Parker & Hale, LLP

(57) ABSTRACT

A plasma display and driving method thereof. A median electrode is formed between X and Y electrodes for receiving sustain pulse voltages, and a reset waveform and a scan pulse voltage are applied to the median electrode. A short gap discharge is performed between the X electrode and the median electrode during the initial interval of a sustain interval, and a long gap discharge is performed between the X and Y electrodes during the normal sustain interval to thus perform a stable discharge. The X and Y electrode drivers are realized through comparable circuits since the waveforms applied to the X and Y electrodes are substantially symmetric.

44 Claims, 14 Drawing Sheets

FOREIGN PATENT DOCUMENTS

| | | | | |
|---|---|---|---|---|
| EP | 0 902 412 | A1 | | 3/1999 |
| EP | 1 174 851 | A2 | | 1/2002 |
| JP | 9-245627 | | | 9/1997 |
| JP | 10-199427 | | | 7/1998 |
| JP | 2000-251746 | | | 9/2000 |
| JP | 2002175043 | A | * | 6/2002 |
| KR | 2002-0021485 | | | 3/2002 |
| KR | 20020058982 | A | * | 7/2002 |
| WO | WO 98/26403 | | * | 6/1998 |

OTHER PUBLICATIONS

Patent Abstracts of Japan, Publication No. 10-199427, dated Jul. 31, 1998, in the name of Hideo Tanabe et al.

Patent Abstracts of Japan, Publication No. 2000-251746, dated Sep. 14, 2000, in the name of Heihi Ko.

European Search Report, dated Mar. 15, 2005, for application No. 04090470.8, in the name of Samsung SDI Co., Ltd.

European Search Report, dated Jul. 18, 2005, for application No. 04090470.8, in the name of Samsung SDI Co., Ltd.

Korean Patent Abstracts for publication No. 1020020021485, date of publication of application Mar. 21, 2002, in the name of J. Kim.

* cited by examiner

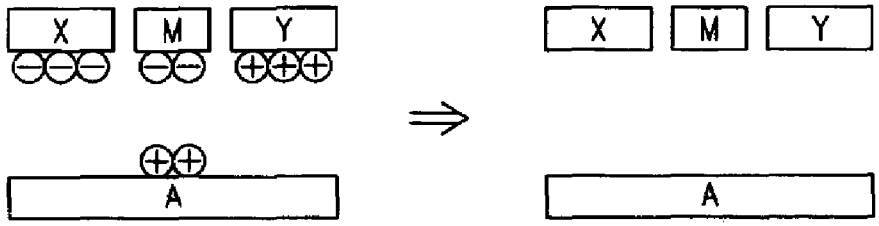
FIG.7B
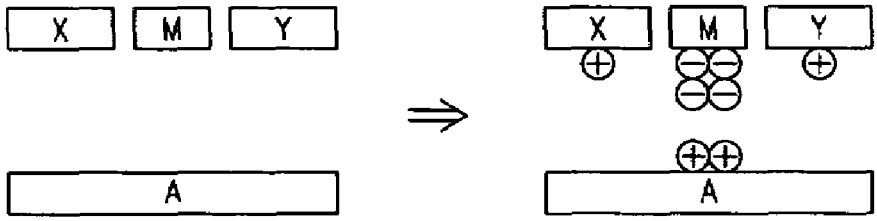
FIG.7C
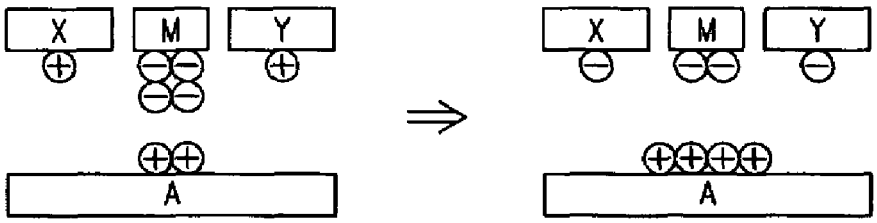
FIG.7D
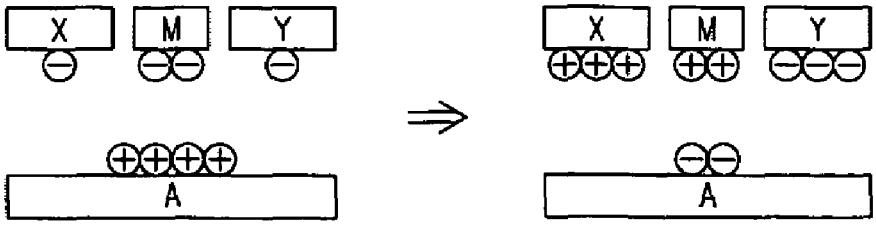

PLASMA DISPLAY AND DRIVING METHOD THEREOF

CROSS REFERENCE TO RELATED APPLICATION

This application claims priority to and the benefit of Korea Patent Application No. 10-2003-0085465 filed on Nov. 28, 2003 in the Korean Intellectual Property Office, the content of which is incorporated herein by reference.

BACKGROUND OF THE INVENTION (a) Field of the Invention

The present invention relates to a plasma display and a driving method thereof.

(b) Description of the Related Art

Recently, flat panel displays, including liquid crystal displays (LCDs), field emission displays (FEDs), and plasma displays, have been actively developed. The plasma displays have better luminance and light emission efficiency as compared to the other types of flat panel devices, and also have wider view angles. Therefore, the plasma displays have come into the spotlight as substitutes for the conventional cathode ray tubes (CRTs) in large displays of greater than 40 inches.

The plasma display is a flat display that uses plasma generated via a gas discharge process to display characters or images, and tens to millions of pixels are provided thereon in a matrix format, depending on its size. Plasma displays are categorized into DC plasma displays and AC plasma displays, according to supplied driving voltage waveforms and discharge cell structures.

Since the DC plasma displays have electrodes exposed in the discharge space, they allow a current to flow in the discharge space while a voltage is supplied, and therefore they problematically require resistors for current restriction. On the other hand, since the AC plasma displays have electrodes covered by a dielectric layer, capacitances are naturally formed to restrict the current, and the electrodes are protected from ion shocks in the case of discharging. Accordingly, the AC plasma displays have a longer lifespan than the DC plasma displays.

FIG. 1 shows a perspective view of an AC PDP, and FIG. 2 shows a cross-sectional view of the PDP of FIG. 1. Referring to FIGS. 1 and 2, X electrode 3 and Y electrode 4, disposed over dielectric layer 14 and protection film 15, are provided in parallel and form a pair with each other under first glass substrate 11. The X and Y electrodes are made of transparent conductive material. Bus electrodes 6 made of metal are respectively formed on the surfaces of the X and Y electrodes 3, 4.

A plurality of address electrodes 5 covered with dielectric layer 14' are installed on second glass substrate 12. Barrier ribs 17 are formed in parallel with address electrodes 5 on dielectric layer 14' between address electrodes 5. Phosphor 18 is formed on the surface of dielectric layer 14' and on both sides of barrier ribs 17. First and second glass substrates 11, 12 having discharge space 19 between them are provided facing each other so that Y electrode 4 may cross over address electrode 5 and X electrode 3 may cross over address electrode 5. Address electrode 5 and discharge space 19 formed at a crossing part of Y electrode 4 and X electrode 3 form discharge cell 20.

FIG. 3 shows a conventional plasma display electrode arrangement diagram. The plasma display electrode has an m×n matrix configuration, and in detail, it has address electrodes A1 to Am in a column direction, and Y electrodes Y1 to Yn and X electrodes X1 to Xn in a row direction, alternately.

Discharge cell 20 shown in FIG. 3 corresponds to discharge cell 20 shown in FIG. 1.

FIG. 4 shows a conventional driving waveform diagram of a plasma display. Each subfield according to the plasma display driving method shown in FIG. 4 includes a reset period, an address period, and a sustain period. The reset period erases wall charge states of a previous sustain, and sets up the wall charges in order to stably perform a next address. In the addressing period, the cells that are turned on and the cells that are not turned on in a panel are selected, and wall charges are accumulated to the cells that are turned on (i.e., the addressed cells). In the sustain period, discharge for actually displaying pictures on the addressed cells is performed by alternately applying sustain voltages to the X and Y electrodes.

Operations of the reset period of the conventional plasma display driving method will now be described in more detail. As shown in FIG. 4, the reset period includes erase period 1, Y ramp rising period II, and Y ramp falling period III.

(1) Erase Period (I)

During this period, a failing ramp that gently falls from sustain voltage Vs to a ground potential is applied to the Y electrode while the X electrode is biased with constant potential Vbias, thereby eliminating the wall charges formed in the previous sustain period.

(2) Y Ramp Rising Period (II)

During this period, the address electrode and the X electrode are maintained at 0V, and a ramp voltage gradually rising from voltage Vs to voltage Vset is applied to the Y electrode. While the ramp voltage rises, weak resetting is generated to all the discharge cells from the Y electrode to the address electrode and the X electrode. As a result, the negative wall charges are accumulated to the Y electrode, and concurrently, the positive wall charges are accumulated to the address electrode and the X electrode.

(3) Y Ramp Falling Period (III)

In the latter part of the reset period, a ramp voltage that gradually falls from the Vs to the ground potential is applied to the Y electrode under the state that the X electrode maintains constant voltage Vbias. While the ramp voltage falls, weak resetting is generated again at all the discharge cells.

However, since insufficient priming particles are generated in the discharge cells when a first sustain pulse is applied after an address period in the conventional plasma display, bad discharge is generated.

The same sustain voltage is alternately applied to the X and Y electrodes in the sustain period to thereby perform a sustain for displaying the actual images on the addressed cells, and it is desirable to apply symmetric waveforms to the X and Y electrodes during the sustain period. However, since the waveform applied to the Y electrode (to which waveforms for resetting and scanning are additionally applied) during the reset period is different from the waveform applied to the X electrode in the conventional plasma display, the circuit for driving the Y electrode is different from the circuit for driving the X electrode. Accordingly, no impedance matching on the driving circuit of the X and Y electrodes is performed, the waveforms alternately applied to the X and Y electrodes in the sustain period are distorted, and bad discharges occur.

SUMMARY OF THE INVENTION

In accordance with the present invention a plasma display for preventing bad discharges, and a driving method thereof, is provided.

In a first aspect of the present invention, a method is provided for driving a plasma display having first and second electrodes for respectively receiving sustain voltage pulses, and third electrodes formed between respective first and second electrodes, wherein in a sustain interval there includes (a) performing a short gap discharge between the first and second electrodes during a first period; and (b) performing a long gap discharge between the first and second electrodes during a second period.

In a second aspect of the present invention, a method for driving a plasma display having first and second electrodes, and third electrodes formed between respective first and second electrodes, includes: (a) applying a reset waveform to the third electrodes during a reset interval; and (b) alternately applying sustain voltage pulses to the first and second electrodes during a sustain interval.

In a third aspect of the present invention, a method is provided for driving a plasma display having first and second electrodes for respectively receiving sustain voltage pulses, and third electrodes formed between respective first and second electrodes, wherein in a reset interval there includes: (a) applying an erase voltage to the third electrodes; (b) applying a rising waveform which rises from a first voltage to a second voltage to the third electrodes; and (c) applying a falling waveform which falls from a third voltage to a fourth voltage to the third electrodes.

In a fourth aspect of the present invention, a method for driving a plasma display having first and second electrodes, and third electrode formed between respective first and second electrodes, includes: (a) applying a reset waveform to the third electrodes during a reset interval; (b) applying a scan pulse to the third electrodes during an address interval; and (c) alternately applying sustain voltage pulses to the first and second electrodes during a sustain interval.

In a fifth aspect of the present invention, a method for driving a plasma display having first and second electrodes, and third electrodes formed between respective first and second electrodes, includes: (a) applying a first voltage to the first electrodes during an address interval; and (b) applying a third voltage to the first electrodes, a fourth voltage which is less than the third voltage to the second electrodes, and a fifth voltage which is greater than one of the first and fourth voltages to the third electrodes.

In a sixth aspect of the present invention, a PDP includes: first and second substrates; first and second electrodes formed on the first substrate, for receiving sustain pulse voltages; third electrodes formed between respective first and second electrodes, for receiving a reset waveform; a dielectric layer for covering the first through third electrodes; an address electrode formed on the second substrate to cross the first through third electrodes; a dielectric layer for covering the address electrode; barrier ribs formed on the top of the dielectric layer of the second substrate; and a phosphor provided between the barrier ribs.

In a seventh aspect of the present invention, a PDP includes: first and second substrates facing with each other; address electrodes formed on the second substrate; barrier ribs provided in the space of between the first and second substrates, for partitioning a plurality of discharge cells; a phosphor layer formed in the discharge cell; sustain electrodes being provided to cross over the address electrodes and face each other in pairs, the sustain electrodes including X and Y electrodes which each have protrusions that are provided to the respective discharge cells and face each other in pairs; and M electrodes provided between the protrusions facing each other in pairs in the sustain electrodes, and formed to cross over the address electrodes, the M electrodes sequentially receiving scan voltage pulses.

In an eighth aspect of the present invention, a plasma display includes: a PDP having a plurality of first and second electrodes for receiving sustain voltage pulses, and a plurality of third electrodes formed between the first and second electrodes respectively; a first electrode driver coupled to the first electrodes, for applying the sustain voltage pulse; a second electrode driver coupled to the second electrodes, for applying the sustain voltage pulse; and a third electrode driver coupled to the third electrodes, for applying a reset waveform to the third electrodes.

In a ninth aspect of the present invention, a plasma display includes: a PDP having a plurality of X and Y electrodes for receiving sustain voltage pulses, and a plurality of M electrodes formed between the X and Y electrodes respectively; an X electrode driver coupled to the X electrodes, for applying the sustain voltage pulse; a Y electrode driver coupled to the Y electrodes, for applying the sustain voltage pulse; a first M electrode driver coupled to a plurality of first M electrodes which belong to a first group from among the M electrodes, for sequentially applying scan pulse voltages to the first M electrodes; and a second M electrode driver coupled to a plurality of second M electrodes which belong to a second group from among the M electrodes, for sequentially applying scan pulse voltages to the second M electrodes.

DETAILED DESCRIPTION

Figure 1:
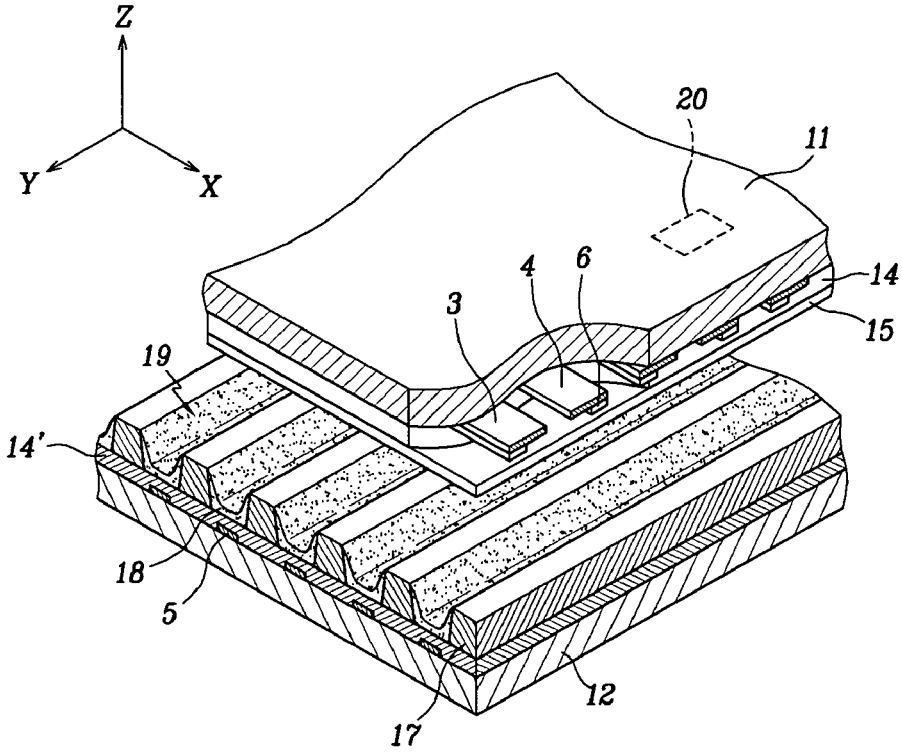
FIG. 1 (Prior Art)
FIG. 1 shows a perspective view of a conventional PDP.
Figure 2:
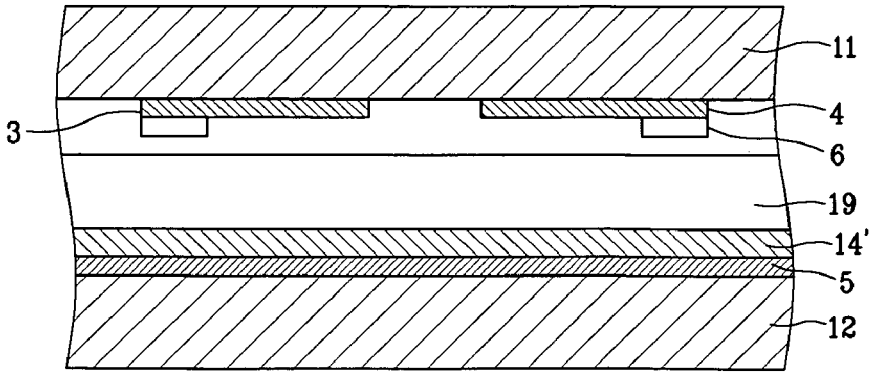
FIG. 2 (Prior Art)
FIG. 2 shows a cross-sectional view of the PDP of FIG. 1.
Figure 3:
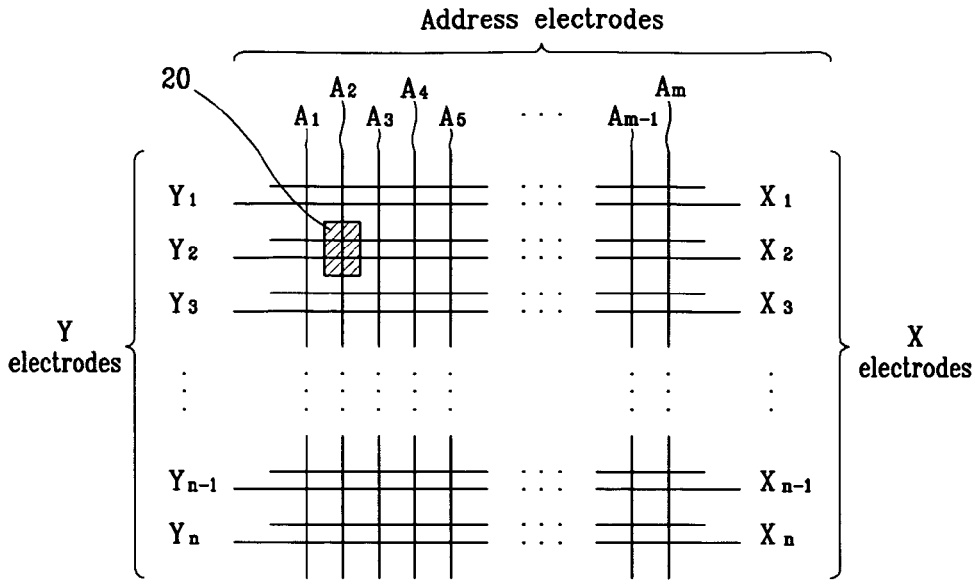
FIG.3(Prior Art)
FIG. 3 shows a conventional electrode arrangement diagram of a plasma display.
Figure 4:
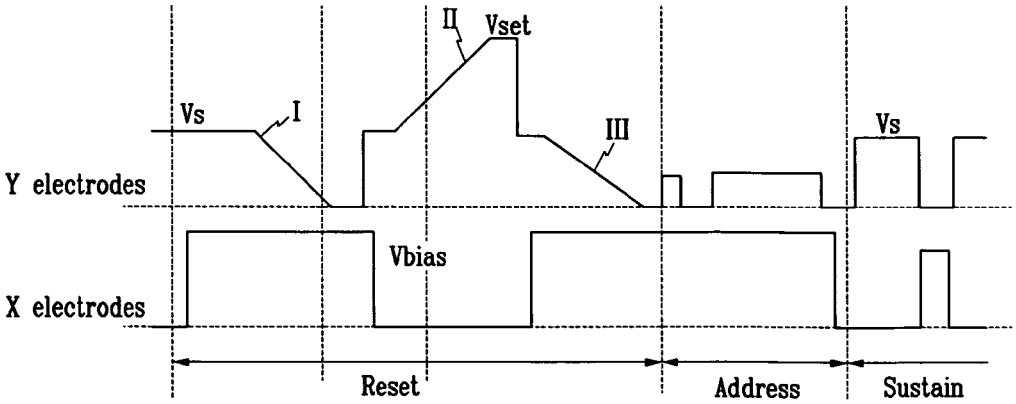
FIG.4(Prior Art)
FIG. 4 shows a conventional driving waveform diagram of a plasma display.
Figure 5:
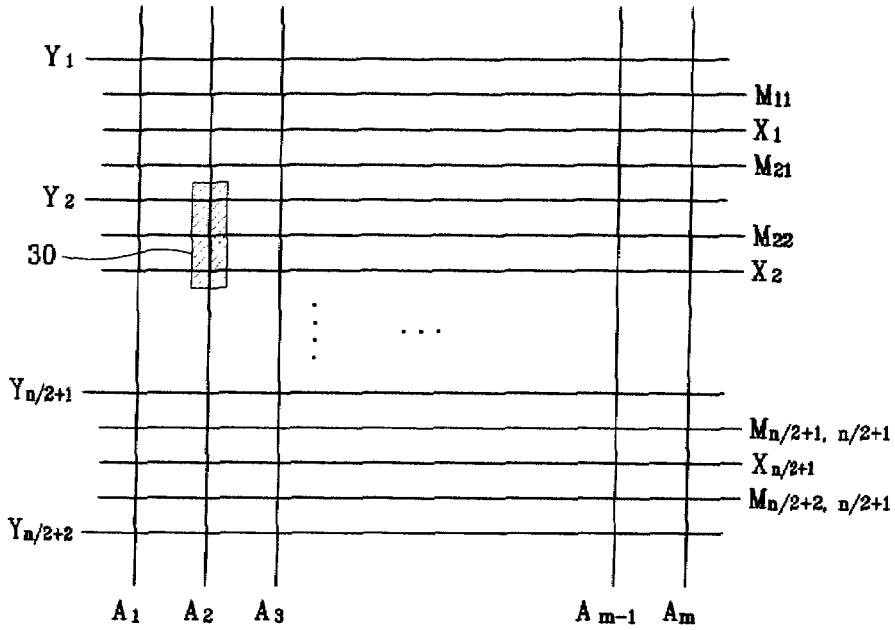
FIG. 5 shows an electrode arrangement diagram of a plasma display according to an exemplary embodiment of the present invention.

FIG. 5 shows an electrode arrangement diagram of a plasma display according to an exemplary embodiment of the present invention. Address electrodes A1 to Am are provided in parallel in a column direction, and (n/2+2) Y electrodes Y1 to Yn/2+2, (n/2+1) X electrodes X1 to Xn/2+1, and n+2 median electrodes (referred to as M electrodes hereinafter) are provided in a row direction. That is, the M electrodes are provided between the Y and X electrodes, and the Y electrode, the X electrode, the M electrode, and the address electrode form single discharge cell 30 to thus configure a four-electrode structure.

The X and Y electrodes function as electrodes for applying sustain voltage waveforms, and the M electrodes function as electrodes for applying reset waveforms and scan pulse voltages.

Referring now to FIGS. 6 and 7A to 7E, a driving method according to the first exemplary embodiment of the present invention will now be described. Each subfield includes a reset period, an address period, and a sustain period, and the reset period includes an erase period, an M electrode rising waveform period, and an M electrode falling waveform period.

(1-1) Erase Period (I)

During the erase period, wall charges formed during the previous sustain period are erased. It is assumed in the exemplary embodiment that a sustain voltage pulse is applied to the X electrode, and a voltage (e.g., a ground voltage) lower than the voltage applied to the X electrode is applied to the Y electrode at the final time of the sustain period. As a result, as shown in FIG. 7A, positive wall charges are formed at the Y and address electrodes, and negative wall charges are formed at the X and M electrodes.

During the erase period, a waveform (a ramp waveform or a logarithmic waveform) that gradually falls from voltage Vmc to the ground voltage is applied to the M electrode while the Y electrode is biased with voltage Vyc. Accordingly, the wall charges that were formed during the sustain period are erased.

(1-2) M Electrode Rising Waveform Period (II)

During this period, a waveform (a ramp waveform or a logarithmic waveform) that gradually rises from voltage Vmd to voltage Vset is applied to the M electrode while the X and Y electrodes are biased with the ground voltage. While the rising waveform is applied, weak resetting is generated from the M electrode to the address, X, and Y electrodes in all the discharge cells. As a result, the negative wall charges are accumulated at the M electrode, and the positive wall charges are accumulated at the address, X, and Y electrodes as shown in FIG. 7B.

(1-3) M Electrode Falling Waveform Period (III)

During the latter part of the reset period, a waveform (a ramp waveform or a logarithmic waveform) that gradually falls from voltage Vme to the ground voltage is applied to the M electrode while the X and Y electrodes are respectively biased with voltages Vxe, Vye. In this instance, it is desirable to set the voltages as Vxe=Vye and Vmd=Vme for a simple circuit configuration, and the exemplary embodiment is not restricted to this.

Weak resetting is generated again while the ramp voltage falls. Since the M electrode falling waveform period is provided for gradually reducing the wall charges accumulated during the M electrode rising waveform period, it is advantageous to the addressing to lengthen the time of the falling waveform since the reduced wall charges can be precisely controlled as the time of the falling waveform becomes longer (i.e., as the gradient becomes gentler).

Figure 7E:
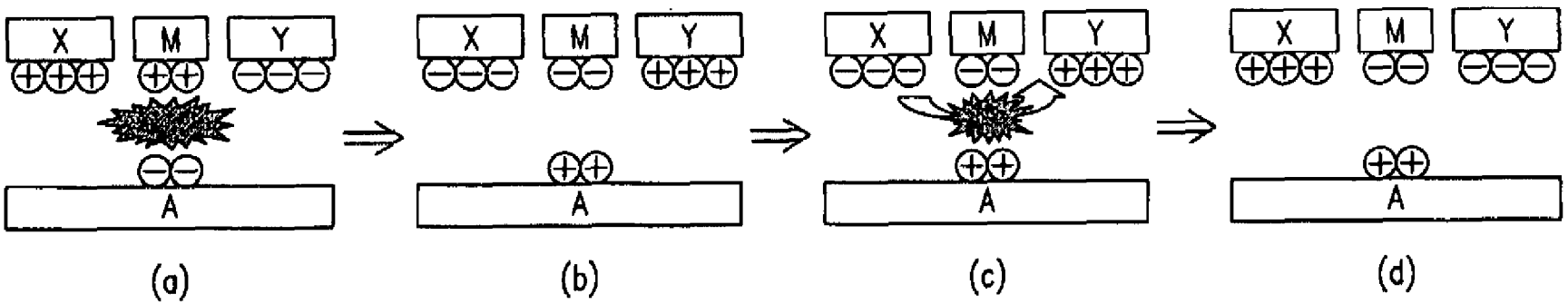
FIGS. 7A to 7E show wall charge distribution diagrams based on the driving waveform according to an exemplary embodiment of the present invention.
Figure 7A:
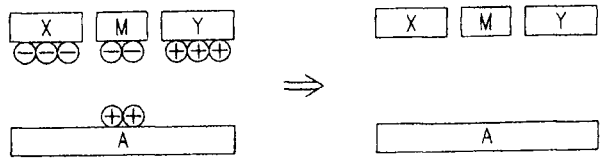
Figure 7B:
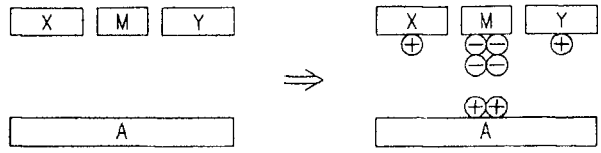
Figure 7C:
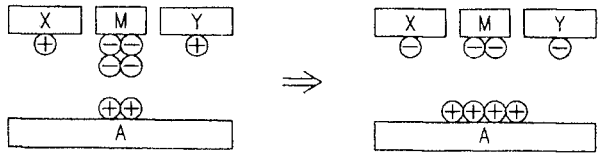

The wall charges accumulated at the respective electrodes of all the cells are uniformly erased according to the result of applying the falling waveforms to the M electrode, and accordingly, the positive wall charges are accumulated to the address electrode, and the negative wall charges are concurrently accumulated to the X, Y, and M electrodes as shown in FIG. 7C.

(2) Address Period (Scan Period)

During the address period, a scan voltage is sequentially applied to the M electrode to thus apply a scan pulse, and an address voltage is applied to the address electrode to thus apply the address voltage to cells to be discharged (i.e., the cells to be turned on) while a plurality of M electrodes are biased with voltage Vsc. The X electrode is maintained at the ground voltage, and voltage Vye is applied to the Y electrode. That is, the voltage greater than the voltage at the X electrode is applied to the Y electrode.

Figure 7D:
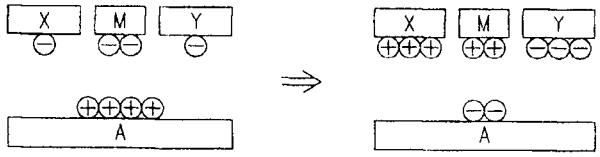

Discharges occur between the M and the address electrodes, and the discharges are extended to the X and Y electrodes, and accordingly, the positive wall charges are accumulated to the X and M electrodes, and the negative wall charges are accumulated to the Y and address electrodes, as shown in FIG. 7D.

(3) Sustain Period

During the sustain period, a sustain voltage pulse is alternately applied to the X and Y electrodes while the M electrode is biased with the sustain voltage of Vm. The sustain is generated at the discharge cells selected in the address period through the above-noted voltage application.

The discharges are generated by different discharge mechanisms at the initial sustain and at the normal time. For ease of description, the discharge that is generated at the initial sustain is referred to as a short-gap discharge period, and the discharge at the normal time is referred to as a long-gap discharge period.

(3-1) Short Gap Discharge Period

As shown in parts (a) and (b) of FIG. 7E, a positive voltage pulse is applied to the X electrode, and a negative voltage pulse is applied to the Y electrode (the positive and negative signs are relative concepts for comparing intensities of the voltages applied to the X and Y electrodes, and applying the positive pulse voltage to the X electrode represents that a voltage greater than the voltage applied to the Y electrode is applied to the X electrode), and a positive voltage pulse is concurrently applied to the M electrode. Therefore, differing from the conventional case in which the discharge occurs between the X electrode and the Y electrode, the discharge occurs between the X electrode/the M electrode and the Y electrode. In particular, the electric field applied between the M and Y electrodes becomes greater since the distance between the M and Y electrodes is shorter than the distance between the X and Y electrodes. Therefore, the discharge between the M and Y electrodes performs a dominant role compared to the discharge between the X and Y electrodes. As described, the discharge between the M and Y electrodes having a relatively shorter distance performs the leading role in the earlier sustain, and it is referred to as the short-gap discharge.

Accordingly, when insufficient priming particles are generated within the discharge cells at the time of applying a first sustain pulse after an address period, sufficient discharge is performed since the short-gap discharge which is executed in the earlier sustain stage by applying a relative high electric field is generated.

(3-2) Long-Gap Discharge Period

Since the voltage at the M electrode is biased with a constant voltage Vm after the first sustain pulse of the sustain is applied, the discharge between the M and X electrodes or between the M and Y electrodes (i.e., the short-gap discharge) performs a minor role, the discharge between the X and Y electrodes becomes the major discharge, and the input image is displayed by the number of discharge pulses alternately applied to the X and Y electrodes.

That is, as shown in part (d) of FIG. 7E, the negative wall charges are continuously accumulated at the M electrode, and the negative wall charges and the positive wall charges are alternately accumulated to the X and Y electrodes in the normal sustain period.

Since the discharge is performed by the short-gap discharge between the X and M electrodes (or between the Y and M electrodes) in the earlier sustain stage, sufficient discharge is performed when the priming particles are less, and since the discharge is performed by the long-gap discharge between the X and Y electrodes in the normal state, stable discharge is performed.

Also, since almost symmetrical voltage waveforms are applied to the X and Y electrode, the circuits for driving the X and Y electrodes are designed in the almost same manner. Therefore, since the difference of the circuit impedance between the X and Y electrodes is almost eliminated, a distortion of the pulse waveforms applied to the X and Y electrodes in the sustain period is reduced, and stable discharge is provided.

Figure 6:
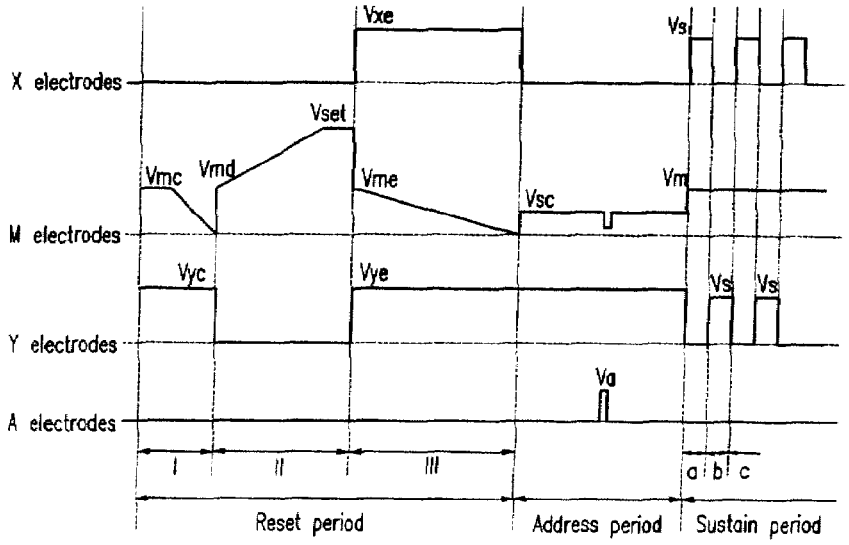
FIG. 6 shows a driving waveform diagram of a plasma display according to a first exemplary embodiment of the present invention.

According to the first exemplary embodiment shown by FIG. 6, reversed waveforms of the X and Y electrodes can be driven, and also, reversed waveforms of the X and Y electrodes can be driven in the address period.

According to the driving method of the first exemplary embodiment, a reset waveform and a scan pulse waveform are mainly applied to the M electrode, and a sustain voltage waveform is mainly applied to the X and Y electrodes. In this instance, various types of reset waveforms as well as the reset waveform shown in FIG. 6 can be applied to the M electrode.

Figure 8:
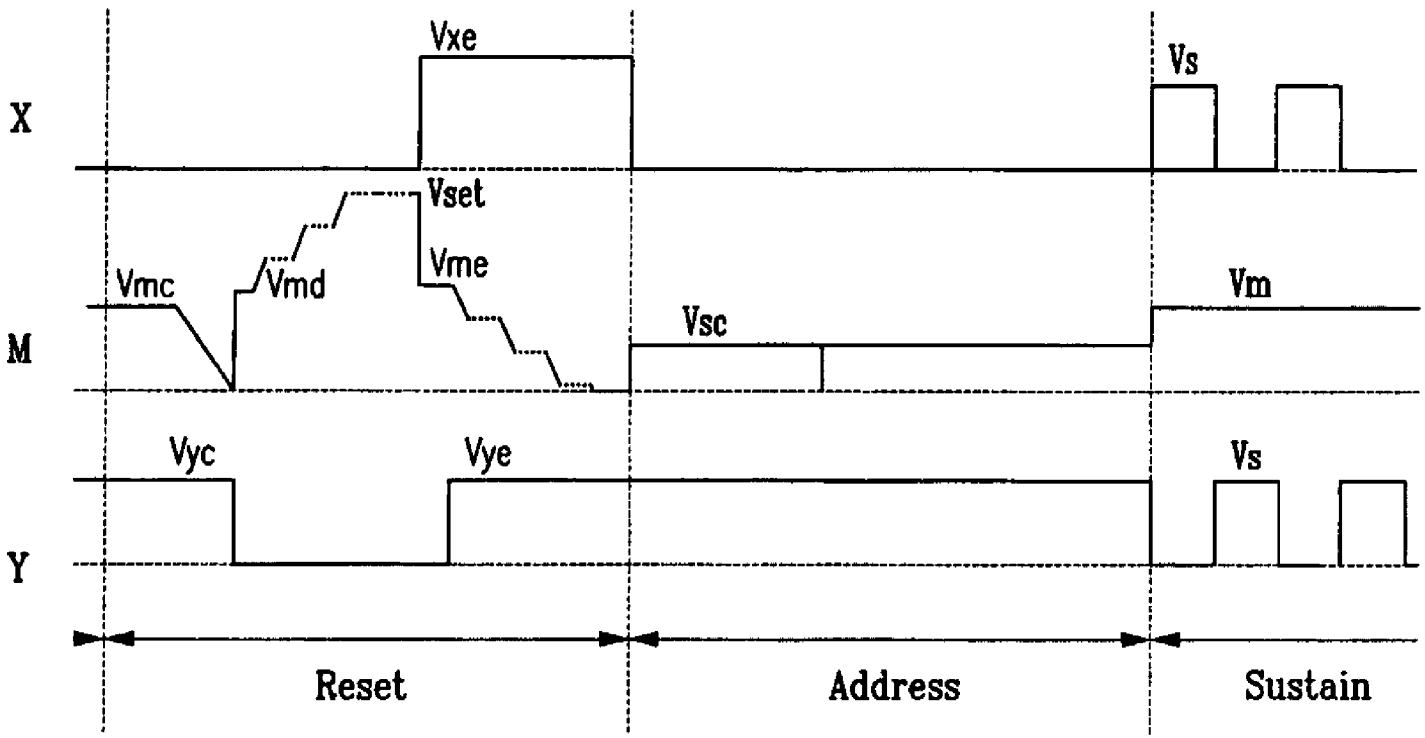
FIG. 8 shows a driving waveform diagram of a plasma display according to a second exemplary embodiment of the present invention.

Referring to FIGS. 7A to 7E and FIG. 8, a driving method according to a second exemplary embodiment of the present invention will be described. FIG. 8 shows a driving waveform diagram of a plasma display according to the second exemplary embodiment of the present invention.

Each subfield includes a reset period, an address period, and a sustain period, and since the descriptions of the address and sustain periods correspond to the driving method shown in FIG. 6, no repeated descriptions will be provided.

The reset period according to the second exemplary embodiment includes an erase period, an M electrode rising/floating waveform period, and an M electrode falling/floating waveform period.

(1) Erase Period

This period functions to erase the wall charges formed in the previous sustain period. Assuming in the second exemplary embodiment that a sustain voltage pulse is applied to the X electrode and a ground voltage is applied to the Y electrode in the last part of the sustain period, the positive wall charges are accumulated at the Y and address electrodes and the negative wall charges are formed at the X and M electrodes.

During the erase period, a waveform (a ramp waveform or a logarithmic waveform) that gradually falls from voltage Vmc to the ground voltage is applied to the M electrode while the Y electrode is biased with voltage Vyc. Accordingly, the wall charges that were formed during the sustain period are erased, as shown in FIG. 7A.

(2) M Electrode Rising/Floating Waveform Period

During this period, a rising/floating waveform for repeatedly applying a rising waveform from voltage Vmd to voltage Vset and performing floating is applied to the M electrode while the X and Y electrodes are biased with the voltage of the ground voltage. While the rising/floating waveform is applied, weak resetting is generated to the X and Y electrodes from the M electrode in all the discharge cells. In detail, when a rising waveform is applied to the M electrode, the resetting occurs in all the discharge cells to accumulate the wall charges, and while the M electrode is floated, the discharge in the discharge space is substantially eliminated. As a result, the negative wall charges are accumulated at the M electrode, and the positive wall charges are concurrently accumulated at the X and Y electrodes as shown in FIG. 7B.

(3) M Electrode Falling/Floating Waveform Period

In the latter part of the reset period, a falling/floating waveform for repeatedly applying a falling waveform from voltage Vme to the ground voltage and performing floating is applied to the M electrode while the X and Y electrodes are respectively biased with voltages Vxe, Vye. Weak resetting is generated at all the discharge cells while the falling/floating waveform is applied.

As a result of applying the falling/floating waveform to the M electrode, the wall charges accumulated at the respective electrodes of all the cells are uniformly erased, and the positive wall charges are accumulated at the address electrode, and the negative wall charged are concurrently accumulated to the X, Y, and M electrodes as shown in FIG. 7C.

Various types of reset waveforms used for the 3-electrode structure in addition to the applied waveform shown in FIGS. 6 and 8 can be applied to the M electrode. Since applying the various types of the reset waveforms to the 4-electrode structure is easily known by the person skilled in the art from the above descriptions, no corresponding descriptions will be provided.

It is desirable to satisfy the four conditions set forth below when the various types of reset waveforms are applied to the 4-electrode structure according to the exemplary embodiment.

First, a voltage waveform Rm(v) applied to the M electrode is to be set to be greater than a voltage waveform Rx(v) applied to the X electrode or a voltage waveform Ry(v) applied to the Y electrode in the rising reset waveform period (i.e., Rm(v)>(Rx(v) or Ry(v)).

Second, a voltage waveform Fm(v) applied to the M electrode is to be set to be less than a voltage waveform Fx(v) applied to the X electrode or a voltage waveform Fy(v) applied to the Y electrode in the falling reset waveform period (i.e., Fm(v)<(Fx(v) or Fy(v)).

Third, a voltage waveform Am(v) applied to the M electrode is to be set to be less than a voltage waveform Ax(v) applied to the X electrode or a voltage waveform Ay(v) applied to the Y electrode in the address period (i.e., Am(v)<(Ax(v) or Ay(v)).

Fourth, a voltage waveform Sm(v) applied to the M electrode is to be set to be greater than a voltage waveform Sx(v) applied to the X electrode or a voltage waveform Sy(v) applied to the Y electrode in the sustain period (i.e., Sm(v)>(Sx(v) or Sy(v)). Further, a voltage waveform Sm(v) applied to the M electrode in the sustain period is to be set to be greater than a voltage waveform Am(v) applied to the M electrode in the address period (i.e., Sm(v)>Am(v)).

Figure 9:
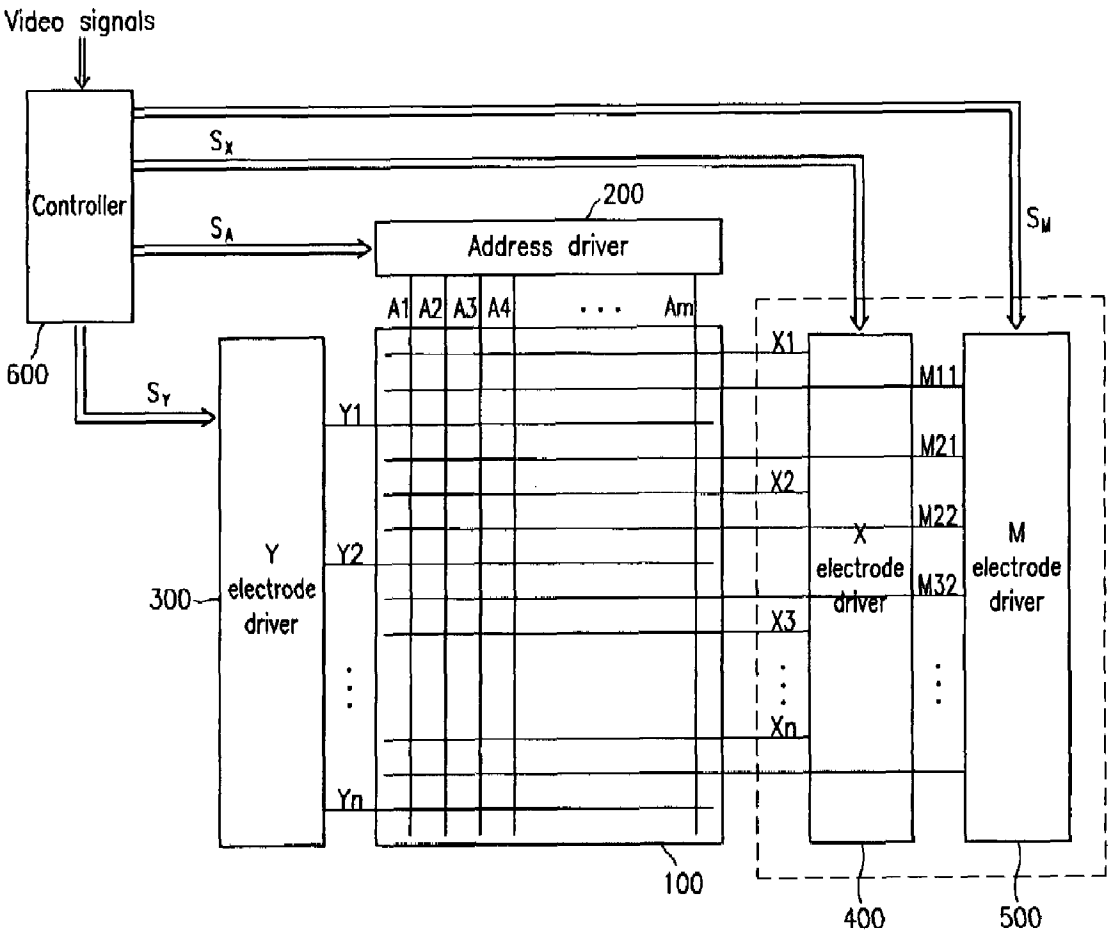
FIGS. 9 and 10 respectively show a plasma display diagram and an electrode arrangement diagram according to a first exemplary embodiment of the present invention.

FIG. 9 shows a plasma display diagram according to the first exemplary embodiment of the present invention.

As shown, the plasma display includes plasma display panel 100, address driver 200, Y electrode driver 300, X electrode driver 400, M electrode driver 500, and controller 600.

Plasma display panel 100 includes a plurality of address electrodes A1 to Am arranged in the column direction, and a plurality of Y electrodes Y1 to Yn, X electrodes X1 to Xn, and Mij electrodes arranged in the row direction. The Mij electrodes represent electrodes formed between the Yi electrodes and the Xj electrodes.

Address driver 200 receives address driving control signal $S_A$ from controller 600, and applies a display data signal for selecting a discharge cell to be displayed to the respective address electrodes.

Y electrode driver 300 and X electrode driver 400 receive Y electrode driving signal $S_Y$ and X electrode driving signal $S_X$ from controller 600, and apply them to the Y and X electrodes respectively.

M electrode driver 500 receives M electrode driving signal $S_M$ from controller 600, and applies it to the M electrodes. In this instance, it is desirable to provide M electrode driver 500 and X electrode driver 400 on the same printed circuit board (PCB) to thus configure a more compact circuit.

Controller 600 receives external video signals, generates address driving control signal $S_A$, Y electrode driving signal $S_Y$, X electrode driving signal $S_X$, and M electrode driving signal $S_M$, and transmits them to address driver 200, Y electrode driver 300, X electrode driver 400, and M electrode driver 500.

Y electrode driver 300 may be provided on one side of the plasma display panel. X electrode driver 400 may be provided on another side thereof. M electrode driver 500 may be provided on a predetermined side thereof (e.g., on the same side as that of the X electrode driver in FIG. 8) in the first exemplary embodiment. That is, all the M electrodes are coupled to the M electrode driver 500 provided on one side of the plasma display panel.

Figure 10:
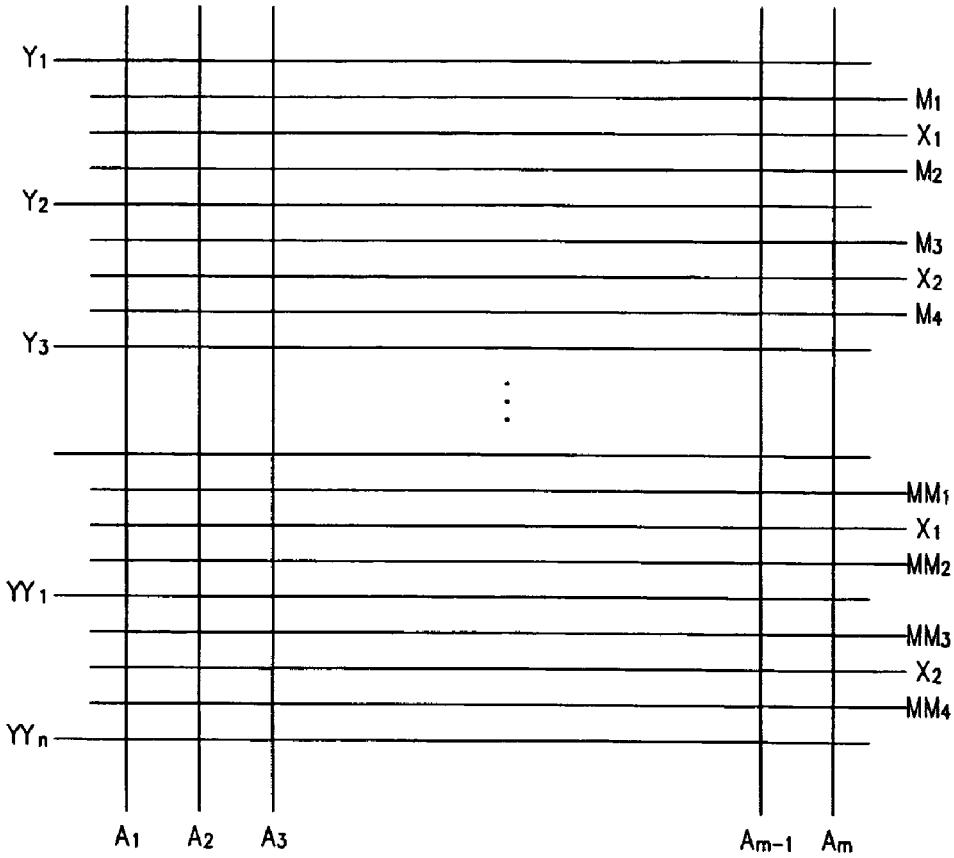

FIG. 10 shows an electrode arrangement diagram according to the first exemplary embodiment of the present invention. As shown, the M electrodes are arranged between the Y and X electrodes. For ease of description, the reference numerals are provided on the positions when the drivers for driving the X, Y, and M electrodes are provided. That is, the reference numeral of the driver for driving the Y electrodes is attached on the left side of the Y electrodes because the driver is provided on the left side thereof, and the reference numerals of the drivers for driving the X and M electrodes are attached on the right side of the X and M electrodes because the drivers are provided on the right side thereof.

In the above-noted electrode arrangement structure, the M electrodes are scanned in the order of M1, M2, M3, . . . , MM1, MM2, MM3 in the case of the single scan, and in the order of (M1, MM1), (M2, MM2), (M3, MM3) in the case of the dual scan during the address period assuming that the scanning direction goes from the top to the bottom on the panel.

Since the M electrodes are coupled to M electrode driver 500 provided at one side of the panel, terminal cables for coupling the M electrodes to the M electrode driver are increased when many M electrodes for realizing high resolution are needed, and hence, the gaps between the coupling terminal cables are narrowed. Therefore, it may cause difficulty in coupling the M electrodes to M electrode driver 500 when the number of electrodes is increased so as to realize high resolution of the plasma display according to the first exemplary embodiment.

Figure 11:
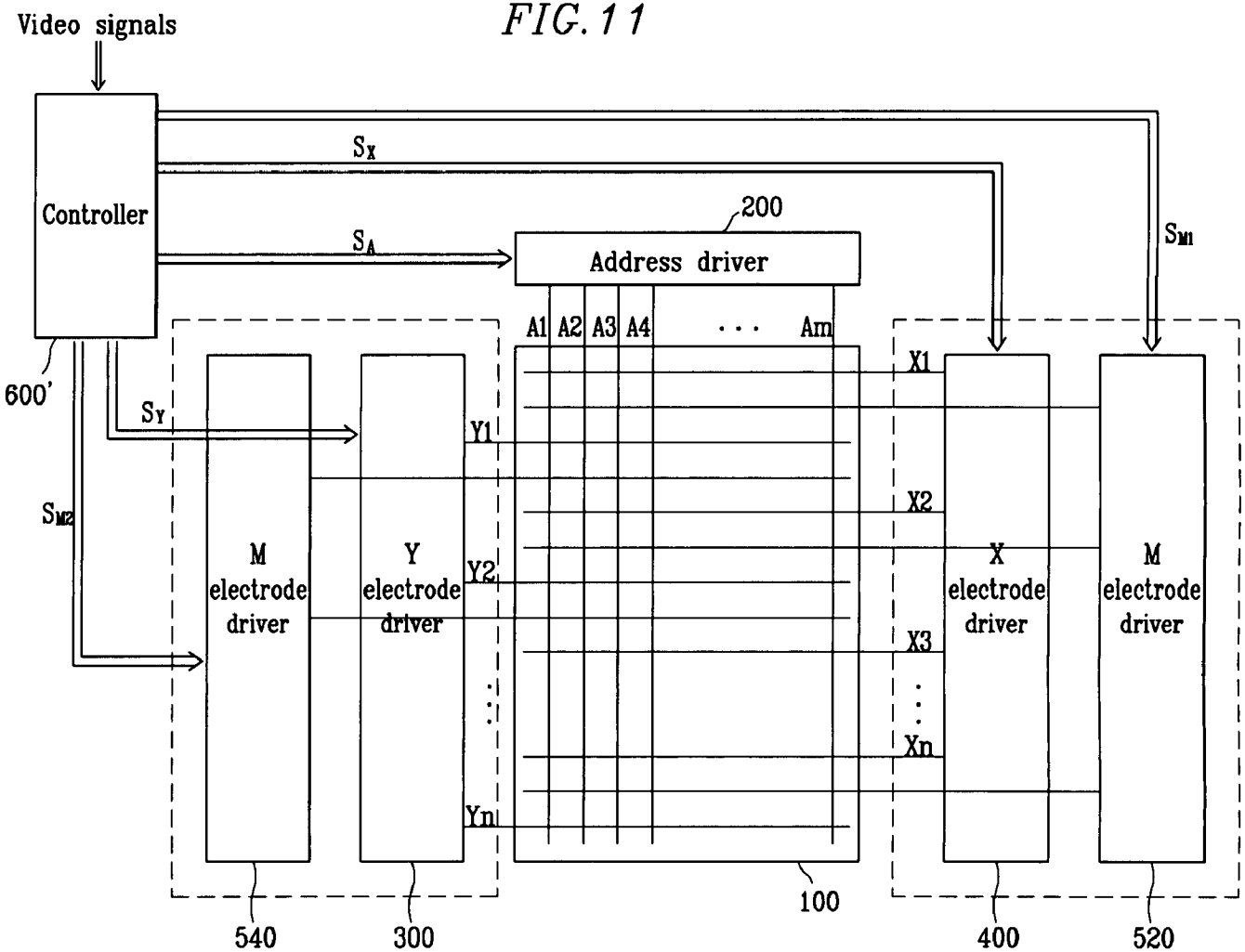
FIGS. 11 and 12 respectively show a plasma display diagram and an electrode arrangement diagram according to a second exemplary embodiment of the present invention.
Figure 12:
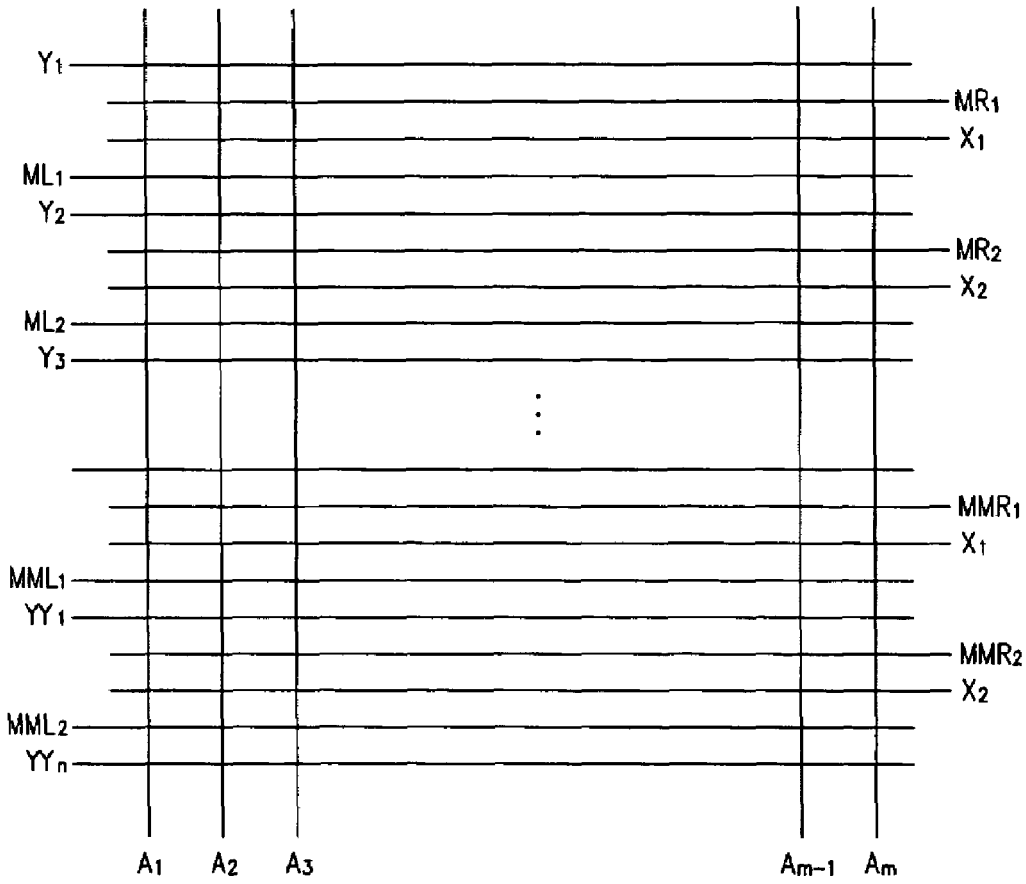

FIGS. 11 and 12 respectively show a plasma display diagram and an electrode arrangement diagram according to a second exemplary embodiment of the present invention. As shown in FIG. 11, the plasma display includes plasma display panel 100, address driver 200, Y electrode driver 300, X electrode driver 400, first M electrode driver 520, second M electrode driver 540, and controller 600'.

First and second electrode drivers 520, 540 for respectively driving odd-line and even-line M electrodes are provided on both sides of plasma display panel 100. The components of FIG. 11 that perform the same functions and operations as those of FIG. 9 have the same reference numerals, and no repeated descriptions will be provided.

First M electrode driver 520 is coupled to odd-line M electrodes, receives M electrode driving signal SM1 for driving the odd-line M electrodes from controller 600', and applies it to the M electrodes. Second M electrode driver 540 is coupled to even-line M electrodes, receives M electrode driving signal SM2 for driving the even-line M electrodes from controller 600', and applies it to the M electrodes. In this instance, it is desirable to provide first M electrode driver 520 and X electrode driver 400, and second M electrode driver 540 and Y electrode driver 300 on the same PCB, respectively.

Since the odd-line M electrodes are coupled to first M electrode driver 520 provided on one side of the panel, and the even-line M electrodes are coupled to second M electrode driver 540 provided on another side of the panel, the gap of the terminal cable for coupling the odd-line M electrode to the first M electrode driver (or the terminal cable for coupling the even-line M electrode to the second M electrode driver) becomes one half the gap of the terminal cable required for the first exemplary embodiment of FIG. 9 when many M electrodes for realizing high resolution are needed.

Accordingly, the terminal coupling is easily performed in the plasma display according to the second exemplary embodiment when the number of electrodes is increased so as to realize the high resolution.

The scanning order of the M electrode in the address period in the electrode arrangement structure of FIGS. 11 and 12 is as follows.

First, the M electrodes are scanned in the order of ML1, ML2, ML3, . . . , MR1, MR2, MR3 in the case of single scan. In this instance, the panel's discharge characteristics may be not uniform since the direction of scanning the odd M electrodes corresponds to that of scanning the even M electrodes.

Therefore, it is advantageous to scan the M electrodes in the order of ML1, ML2, ML3, . . . , MR3, MR2, MR1 in the case of single scan (i.e., the direction of line-scanning the odd M electrodes is set to be opposite the direction of line-scanning the even M electrodes) when regarding the panel's discharge characteristics.

The M electrodes are scanned in the order of (ML1, MML1), (ML2, MML2), . . . , (MR2, MMR2), (MR1, MMR1) or in the order of (ML1, MML1), (ML2, MML2), . . . , (MR1, MMR1), (MR2, MMR2) in the case of a dual scan.

The odd-line M electrodes and the even-line M electrodes are coupled to first M electrode driver 520 and second M electrode driver 540 respectively provided on the right and left of the plasma display panel, and in addition, the M electrodes are classified into groups through various methods, and the respective groups are coupled to the first and second M electrode drivers 520 and 540.

Figure 13:
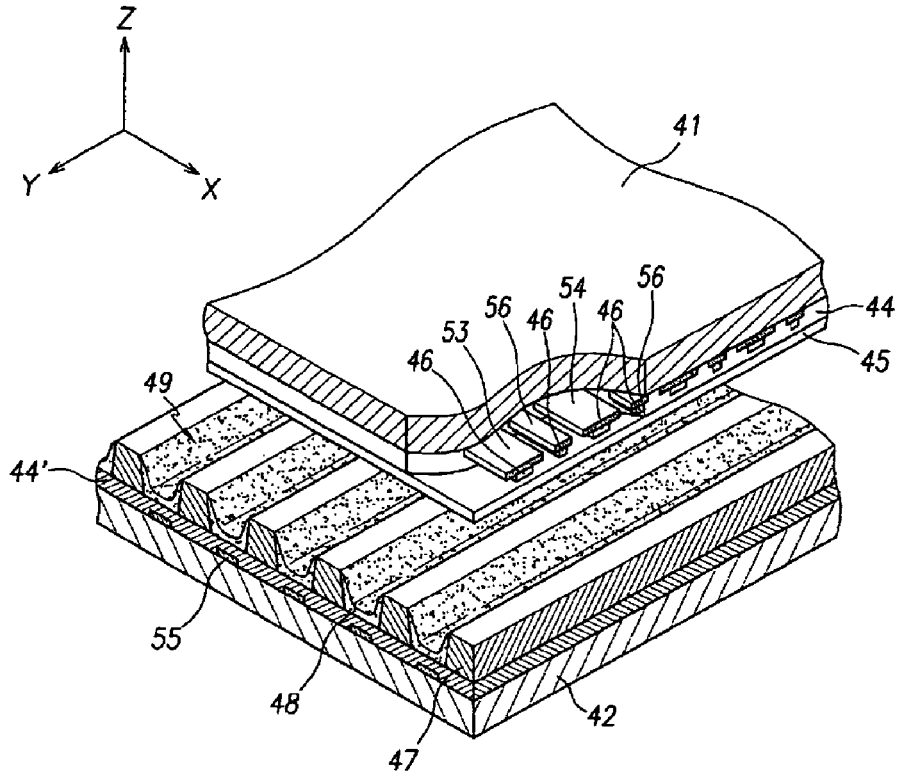
FIGS. 13 and 14 respectively show a perspective view and a cross-sectional view of the PDP according to a first exemplary embodiment of the present invention.
Figure 14:
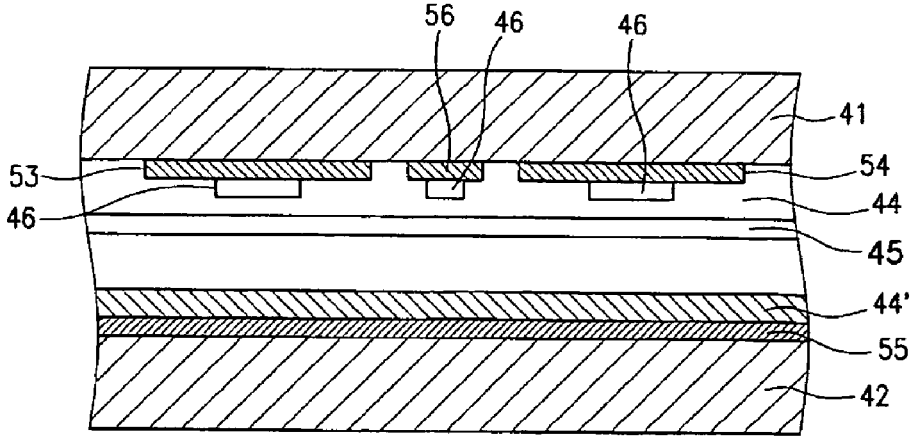

FIGS. 13 and 14 respectively show a perspective view and a cross-sectional view of the PDP according to the first exemplary embodiment of the present invention. Referring to FIGS. 13 and 14, the plasma display panel comprises first substrate 41 and second substrate 42. X electrode 53 and Y electrode 54 are formed on first substrate 41. Bus electrode 46 is formed on X and Y electrodes 53, 54. Dielectric layer 44 and protection film 45 are sequentially formed on X and Y electrodes 53, 54.

Address electrodes 55 are formed on the surface of second substrate 42, and dielectric layer 44' is formed on address electrodes 55. Barrier ribs 47 are formed on dielectric layer 44' to thereby form cells 49 which are discharge spaces between barrier ribs 47. Phosphor 48 is coated on the surface of barrier rib 47 in the cell space between barrier ribs 47. X and Y electrodes 53, 54 are formed perpendicular to address electrode 55.

M electrode 56 is formed between the one pair of X and Y electrodes 53, 54 formed on the surface of first substrate 41. A reset waveform and a scan waveform are applied to the M electrode. Bus electrode 46 is formed on M electrode 56.

M electrodes are provided between the Xi electrodes and the Yi electrodes and between the Yi+1 electrodes and the Xi+1 electrodes in the plasma display panel according to the first exemplary embodiment. That is, n M electrodes are provided when (n/2+1) X and Y electrodes are provided.

Figure 15:
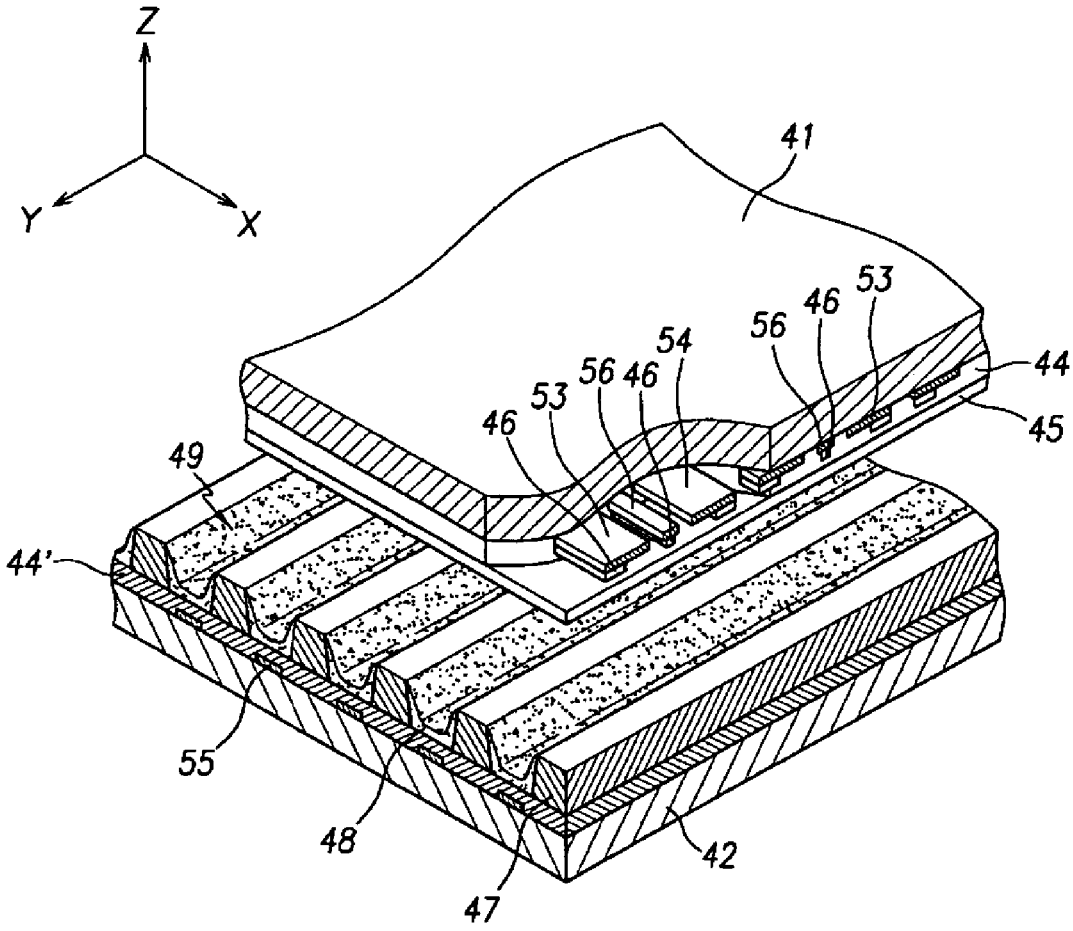
FIG. 15 shows another exemplified PDP according to a first exemplary embodiment of the present invention.

In addition, as shown in FIG. 15, M electrodes 56 may be provided between Xi electrodes 53 and Yi electrodes 54, and not between the Yi electrodes and the Xi+1 electrodes. In this case, the number of the X, Y, and M electrodes is n.

Figure 16:
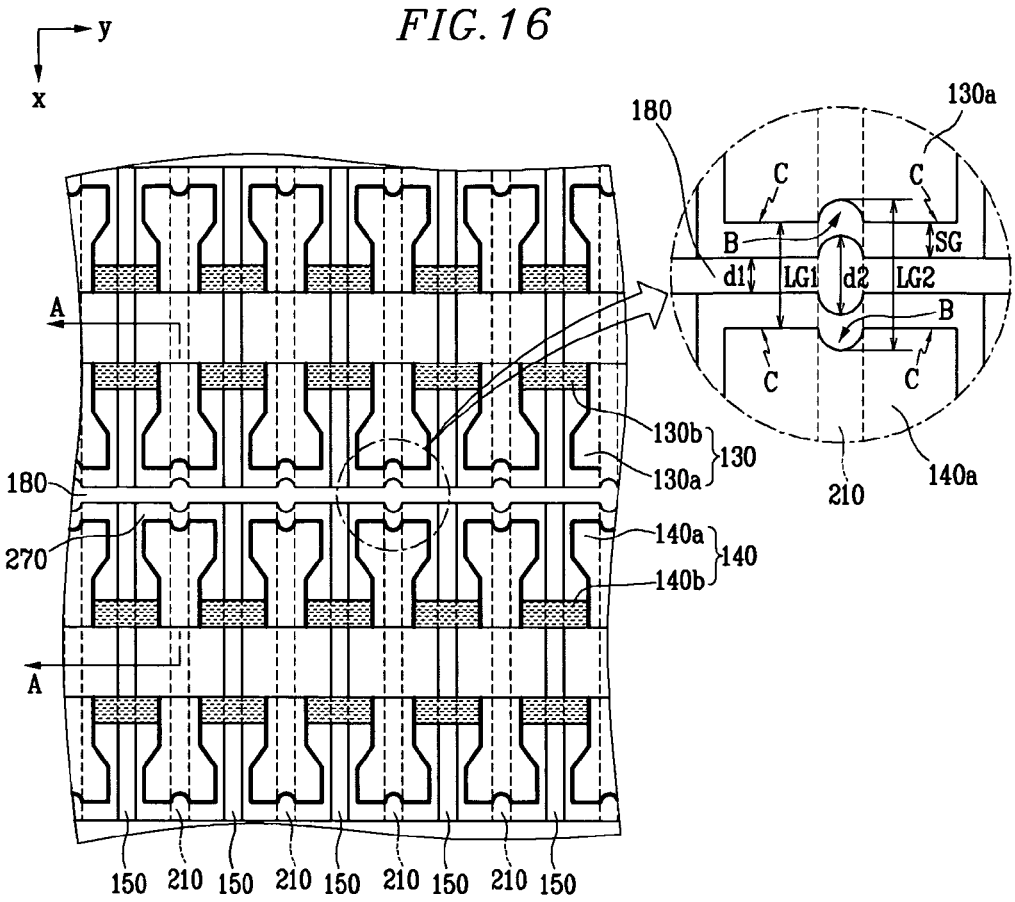
FIGS. 16 and 17 respectively show a plan view and a cross-sectional view of the PDP according to a second exemplary embodiment of the present invention.
Figure 17:
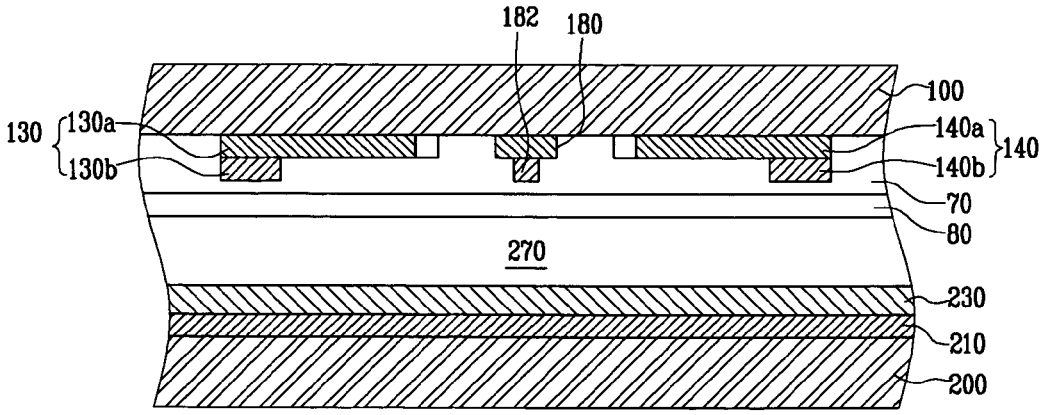

FIG. 16 shows a partial plan view of the PDP according to a second exemplary embodiment of the present invention, and FIG. 17 shows a partial cross-sectional view with respect to a line A-A of FIG. 16. The plasma display panel includes first substrate 100 and second substrate 200. A plurality of address electrodes 210 is formed in one direction (the direction of the y axis) on second substrate 200, and a plurality of X electrodes 130 and Y electrodes 140 is formed in the direction perpendicular to the direction of address electrodes 210 (the direction of the x axis) on first substrate 100. X and Y electrodes 130, 140 in pairs correspond to respective discharge cells 270. Dielectric layer 70 and protection film 80 are sequentially formed on first substrate 100, and cover X and Y electrodes 130, 140. Dielectric layer 230 is formed on second substrate 200, and covers address electrodes 210.

A plurality of barrier ribs 150 is formed between first and second substrates 100, 200. Barrier ribs 150 are respectively arranged between adjacent address electrodes 210 and in parallel with address electrodes 210, and form discharge cells 270 needed for discharging the plasma.

X electrode 130 and Y electrode 140 for forming a sustain electrode each includes protrusive electrodes 130*a*, 140*a* and bus electrodes 130*b*, 140*b*. Protrusive electrodes 130*a*, 140*a* function to generate a plasma discharge in discharge cell 270, and it is desirable to apply transparent indium tin oxide (ITO) electrodes for obtaining the brightness to protrusive electrode 130*a*, 140*a*, and it is desirable to apply metallic electrodes to bus electrodes 130*b*, 140*b* so as to compensate for high resistance of the transparent electrodes and obtain conductivity. The one pair of bus electrodes 130*b*, 140*b* corresponding to each discharge cell 270 are formed in parallel, and protrusive electrodes 130*a*, 140*a* are protruded toward each discharge cell 270 from respective bus electrodes 130*b*, 140*b* so that they may face each other.

M electrode 180 is formed between X and Y electrodes 130, 140 formed on the first substrate, and bus electrode 182 is formed on M electrode 180.

As shown in FIG. 16, concave unit B is formed in the center of protrusive electrodes 130*a*, 140*a*, and flat units C are formed on both sides of concave unit B. Length d2 of the center part of the M electrode, the center part corresponding to concave unit B of protrusive electrodes 130*a*, 140*a*, is longer than length d1 of the edge part thereof. Address electrode 210 is formed to be superimposed on concave unit B of the protrusive electrode and the center part of the M electrode.

Short gap SG is formed between M electrode 180 and respective protrusive electrodes 130*a*, 140*a*. Long gap LG is formed between the protrusive electrodes. A main discharge starts from the initial short gap to the long gap to be spread to the whole discharge cell 270.

Length LG2 of the long gap between concave units B of protrusive electrodes 130*a*, 140*a* is greater than length LG1 of the long gap between concave units B. Therefore, the electrode structure according to the second exemplary embodiment has better addressing efficiency since the region where the address electrode at which the address is generated and the M electrode meet has a relatively wide area. Also, the sustain voltage is reduced since distance LG1 between flat units C of protrusive electrodes 130*a*, 140*a* operable for the sustain can be established to be short.

Figure 18A:
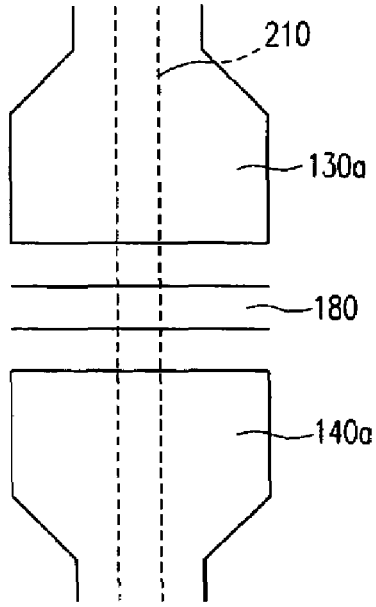
FIGS. 18A and 18B show exemplified PDP electrode configurations according to a second exemplary embodiment of the present invention.
Figure 18B:
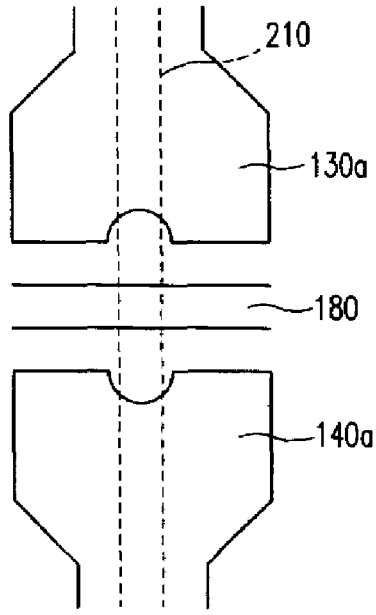

As described, concave unit B and flat unit C are formed on the protrusive electrodes 130*a*, 140*a* arranged on one side of the sustain electrodes 130, 140, or on protrusive electrodes 130*a*, 140*a* arranged on both sides of the sustain electrodes 130, 140. Also, configurations of the protrusive electrodes 130*a*, 140*a* and M electrode 180 are varied as shown in FIGS. 18A and 18B.

Further, the failure of discharge is prevented by forming an M electrode between the X and Y electrodes, applying a reset waveform and a scan waveform to the M electrode, and applying a sustain voltage waveform to the X and Y electrodes.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A method for driving a plasma display comprising a plurality of discharge cells, first electrodes and second electrodes for receiving sustain voltage pulses, and third electrodes between respective said first electrodes and second electrodes, the method comprises:

during a sustain interval, (a) performing a short gap discharge between the first electrodes and the third electrodes during a first period; and (b) performing a long gap discharge between the first electrodes and the second electrodes during a second period, wherein the sustain voltage pulses are alternately applied to the first electrodes and the second electrodes; and during a reset interval, applying a gradually falling voltage waveform to the third electrodes to prepare the discharge cells for addressing while a first positive voltage is applied to the first electrodes and a second positive voltage is applied to the second electrodes.

2. The method of claim 1, wherein a first sustain is generated during the first period.

3. The method of claim 2, wherein the second period is an interval provided after the first sustain.

4. The method of claim 1, wherein during the first period and the second period, said sustain voltage pulses switched from a first voltage to a second voltage which is greater than the first voltage are alternately applied to the first electrodes and the second electrodes respectively, and the third electrodes are biased by a third voltage which is greater than the first voltage.

5. The method of claim 1, wherein a first voltage is applied to the first electrodes and a second voltage which is greater than the first voltage is applied to the second electrodes during an address interval.

6. The method of claim 5, wherein performing the short gap discharge comprises applying the sustain voltage pulses and a third voltage to the first electrodes and the second electrodes respectively, and applying a fourth voltage which is greater than the third voltage to the third electrodes.

7. The method of claim 6, wherein performing the long gap discharge comprises alternately applying the sustain voltage pulses to the first electrodes and the second electrodes, and biasing the third electrodes by the fourth voltage.

8. The method of claim 6, wherein the third voltage is a ground voltage.

9. The method of claim 5, wherein the first voltage is a ground voltage.

10. The method of claim 1, wherein a scan pulse voltage is applied to the third electrodes during an address interval.

11. A method for driving a plasma display comprising a plurality of discharge cells, first electrodes and second electrodes, and third electrodes between respective said first electrodes and said second electrodes, the method comprising:

(a) applying a reset waveform to the third electrodes during a reset interval; and (b) alternately applying sustain voltage pulses to the first electrodes and the second electrodes during a sustain interval, wherein the reset waveform comprises a gradually falling voltage waveform to prepare the discharge cells for addressing, and wherein the method further comprises applying a first positive voltage to the first electrodes and applying a second positive voltage to the second electrodes while applying the gradually falling voltage waveform to the third electrodes.

12. The method of claim 11, wherein a scan pulse voltage is applied to the third electrodes during an address interval provided between the reset interval and the sustain interval.

13. The method of claim 12, wherein a first voltage is applied to the first electrodes and a second voltage which is greater than the first voltage is applied to the second electrodes during the address interval.

14. The method of claim 13, wherein the sustain voltage pulses and a third voltage are applied to the first electrodes and the second electrodes respectively, and a fourth voltage which is greater than the third voltage is applied to the third electrodes during a first period of the sustain interval.

15. The method of claim 14, wherein a first sustain is generated during the first period.

16. The method of claim 14, wherein sustain pulses are alternately applied to the first electrodes and the second electrodes, and the third electrodes are biased by the fourth voltage during a second period of the sustain interval.

17. The method of claim 11 further comprising:

applying an erase voltage to the third electrodes; and applying a rising waveform which rises from the first voltage to the second voltage to the third electrodes.

18. A method for driving a plasma display comprising first electrodes and second electrodes for receiving sustain voltage pulses, and third electrodes between respective said first electrodes and said second electrodes, wherein the method comprises:

during a reset interval:

(a) applying an erase voltage to the third electrode;

(b) applying a rising waveform which rises from a first voltage to a second voltage to the third electrode; and (c) applying a falling waveform which falls from a third voltage to a fourth voltage to the third electrodes while applying a first positive voltage to the first electrodes and applying a second positive voltage to the second electrodes; and during a sustain interval, applying the sustain voltage pulses alternately to the first electrodes and the second electrodes.

19. The method of claim 18, wherein said applying the erase voltage comprises:

applying a falling waveform which falls from a fifth voltage to a sixth voltage to the third electrodes;

biasing the first electrode by a seventh voltage which is less than the fifth voltage; and biasing the second electrodes by an eighth voltage which is greater than the seventh voltage.

20. The method of claim 19, wherein a final sustain voltage is applied to the first electrodes during the sustain interval of a previous subfield.

21. The method of claim 18, wherein said applying the rising waveform comprises: applying a rising or floating waveform for repeating said applying of the rising waveform and floating to the third electrodes.

22. The method of claim 18, wherein said applying the falling waveform comprises: applying a falling or floating waveform for repeating said applying of the falling waveform and floating to the third electrodes.

23. A method for driving a plasma display comprising a plurality of discharge cells, first electrodes and second electrodes, and third electrodes between respective said first electrodes and said second electrodes, the method comprising:

(a) applying a reset waveform to the third electrodes during a reset interval;

(b) applying a scan pulse to the third electrodes during an address interval; and (c) alternately applying sustain voltage pulses to the first electrodes and the second electrodes during a sustain interval, wherein the reset waveform comprises a gradually falling voltage waveform to prepare the discharge cells for addressing, and wherein the method further comprises applying a first positive voltage to the first electrodes and applying a second positive voltage to the second electrodes while applying the gradually falling voltage waveform to the third electrodes.

24. The method of claim 23, wherein a scan pulse is applied to the third electrodes during the address interval provided between the reset interval and the sustain interval.

25. The method of claim 24, wherein a first voltage is applied to the first electrodes and a second voltage which is greater than the first voltage is applied to the second electrodes during the address interval.

26. The method of claim 25, wherein the sustain voltage pulses and a third voltage are applied to the first electrodes and the second electrodes respectively, and a fourth voltage which is greater than the third voltage is applied to the third electrodes during a first period of the sustain interval.

27. The method of claim 26, wherein a first sustain is generated during the first period.

28. The method of claim 26, wherein the sustain voltage pulses are alternately applied to the first electrodes and the second electrodes, and the third electrodes are biased by the fourth voltage during a second period of the sustain interval.

29. A method for driving a plasma display comprising a plurality of discharge cells, first electrodes and second electrodes, and third electrodes between respective said first electrodes and said second electrodes, the method comprising:

(a) applying a gradually falling voltage waveform to the third electrodes during a reset interval to prepare the discharge cells for addressing while applying a first positive voltage to the first electrodes and applying a second positive voltage to the second electrodes;

(b) applying a first voltage to the first electrodes during an address interval; and (c) applying a third voltage to the first electrodes, a fourth voltage which is less than the third voltage to the second electrodes, and a fifth voltage which is greater than one of the first and the fourth voltages to the third electrodes during a sustain interval.

30. The method of claim 29, wherein a scan pulse is applied to the third electrodes during the address interval.

31. A plasma display panel comprising:

a first substrate and a second substrate;

a plurality of discharge cells between the first substrate and the second substrate;

first electrodes and second electrodes on the first substrate, for receiving sustain pulse voltages alternately applied to the first electrodes and the second electrodes;

third electrodes between respective said first and said second electrodes, for receiving a reset waveform;

a first dielectric layer for covering the first electrodes, the second electrodes and the third electrodes;

address electrodes on the second substrate crossing the first electrodes, the second electrodes and the third electrodes;

a second dielectric layer for covering the address electrodes;

barrier ribs on the second dielectric layer of the second substrate; and a phosphor between the barrier ribs, wherein, during a reset interval, the third electrodes are applied with a gradually falling voltage waveform to prepare the discharge cells for addressing while a first positive voltage is applied to the first electrodes and a second positive voltage is applied to the second electrodes.

32. The plasma display panel of claim 31, wherein a scan pulse voltage is applied to the third electrodes.

33. A plasma display panel comprising:

a first substrate and a second substrate facing each other;

address electrodes on the second substrate;

barrier ribs between the first substrate and the second substrate, for partitioning a plurality of discharge cells;

a phosphor layer in the discharge cells;

sustain electrodes on the first substrate crossing the address electrodes and facing each other in pairs, the sustain electrodes comprising X electrodes and Y electrodes having respective protrusions into respective discharge cells and facing each other in pairs, the X electrodes and the Y electrodes adapted to be applied with sustain pulse voltages alternately; and M electrodes on the first substrate between the protrusions and crossing the address electrodes, the M electrodes adapted to sequentially receive scan voltage pulses, wherein, during a reset interval, the M electrodes are applied with a gradually falling voltage waveform to prepare the discharge cells for addressing while a first positive voltage is applied to the X electrodes and a second positive voltage is applied to the Y electrodes.

34. The plasma display panel of claim 33, wherein a concave unit is formed in a center of each said protrusion provided on at least one side of the sustain electrodes in pair.

35. The plasma display panel of claim 33, wherein flat units are formed adjacent to each said protrusion.

36. The plasma display panel of claim 33, wherein a length of the M electrode corresponding to the concave unit of the protrusion is longer than a length of the M electrode corresponding to the flat unit of the protrusion.

37. A plasma display comprising:

a plasma display panel comprising a plurality of discharge cells, a plurality of first electrodes and a plurality of second electrodes for receiving sustain voltage pulses alternately applied to the first electrodes and the second electrodes, and a plurality of third electrodes between respective said first electrodes and said second electrodes;

a first electrode driver coupled to the first electrodes, for applying the sustain voltage pulses during a sustain interval and applying a first positive voltage during a reset interval;

a second electrode driver coupled to the second electrodes, for applying the sustain voltage pulses during the sustain interval and applying a second positive voltage during the reset interval; and a third electrode driver coupled to the third electrodes, for applying reset waveforms to the third electrodes while the first positive voltage is applied to the first electrodes and the second positive voltage is applied to the second electrodes during the reset interval, wherein, the reset waveforms comprise a gradually falling voltage waveform for preparing the discharge cells for addressing.

38. The plasma display of claim 37, wherein the first electrode driver and the third electrode driver are provided on a first surface of the plasma display panel.

39. The plasma display of claim 38, wherein the first electrode driver and the third electrode driver are formed on the same printed circuit board.

40. A plasma display comprising:

a plasma display panel comprising a plurality of discharge cells, a plurality of X electrodes and Y electrodes for receiving sustain voltage pulses alternately applied to the X electrodes and the Y electrodes, and a plurality of M electrodes between respective said X electrodes and said Y electrodes;

an X electrode driver coupled to the X electrodes, for applying the sustain voltage pulses during a sustain interval and applying a first positive voltage during a reset interval;

a Y electrode driver coupled to the Y electrodes, for applying the sustain voltage pulses during the sustain interval and applying a second positive voltage during the reset interval;

a first M electrode driver coupled to a plurality of first M electrodes belonging to a first group from among the M electrodes, for sequentially applying scan pulse voltages to the first M electrodes; and a second M electrode driver coupled to a plurality of second M electrodes belonging to a second group from among the M electrodes, for sequentially applying scan pulse voltages to the second M electrodes;

wherein, during the reset interval, the first and the second M electrodes are applied with a gradually falling voltage waveform to prepare the discharge cells for addressing while the first positive voltage is applied to the X electrodes and the second positive voltage is applied to the Y electrodes during the reset interval.

41. The plasma display of claim 40, wherein the first M electrode driver and the second M electrode driver respectively apply reset waveforms to the first M electrodes and the second M electrodes during the reset interval.

42. The plasma display of claim 40, wherein the first M electrode driver and the second M electrode driver face each other with reference to the plasma display panel.

43. The plasma display of claim 42, wherein the first M electrode driver and the X electrode driver are formed on the same printed circuit board.

44. The plasma display of claim 40, wherein the first M electrodes are odd M electrodes, and the second M electrodes are even M electrodes.

* * * * *

UNITED STATES PATENT AND TRADEMARK OFFICE

CERTIFICATE OF CORRECTION

PATENT NO. : 7,616,176 B2
APPLICATION NO. : 10/998469
DATED : November 10, 2009
INVENTOR(S) : Yi et al.

It is certified that error appears in the above-identified patent and that said Letters Patent is hereby corrected as shown below:

In the Drawings

The drawing sheet 4 of 14 consisting of Fig(s) 7B-7D should be deleted and substitute therefore the attached drawing sheet 4 of 14 consisting of Fig(s) 7A-7D.

Signed and Sealed this
First Day of May, 2012

David J. Kappos

David J. Kappos
*Director of the United States Patent and Trademark Office*